US010796867B1

(12) United States Patent
Li et al.

(10) Patent No.: US 10,796,867 B1
(45) Date of Patent: Oct. 6, 2020

(54) COIL-TYPE AXIAL MAGNETIC FIELD CONTACT ASSEMBLY FOR VACUUM INTERRUPTER

(71) Applicant: Eaton Intelligent Power Limited, Dublin (IE)

(72) Inventors: Wangpei Li, Horseheads, NY (US); Eric D. Smith, Painted Post, NY (US); Xin Zhou, Wexford, PA (US); Ganesh Kumar Balasubramanian, Horseheads, NY (US); Louis G. Campbell, Elmira, NY (US); Darron R. Mohr, Big Flats, NY (US); Mrinalini Pathak, Pune (IN)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/572,720

(22) Filed: Sep. 17, 2019

Related U.S. Application Data

(60) Provisional application No. 62/885,571, filed on Aug. 12, 2019.

(51) Int. Cl.
*H01H 33/664* (2006.01)

(52) U.S. Cl.
CPC ... *H01H 33/6644* (2013.01); *H01H 2211/006* (2013.01); *H01H 2227/024* (2013.01)

(58) Field of Classification Search
CPC ..... H01H 33/664; H01H 33/6641; H01H 33/6642; H01H 33/6643; H01H 33/6644; H01H 33/6645; H01H 2211/006; H01H 2227/024
USPC ..... 218/30, 123, 127–130, 141, 118
See application file for complete search history.

(56) References Cited

U.S. PATENT DOCUMENTS 4,260,864 A 4/1981 Wayland et al.
4,584,445 A * 4/1986 Kashiwagi ..... H01H 1/0203 200/265
4,588,879 A * 5/1986 Noda ..... H01H 33/6644 218/127
4,871,888 A 10/1989 Bestel
(Continued)

OTHER PUBLICATIONS

Wang, Zihan et al., "Design Optimization of a 3/4 Coil-Type Axial Magnetic Field Contact for 126kV Vacuum Interrupter", 2017 4th International Conference on Electric Power Equipment—Seitching Technology—Xi'an—China.
(Continued)

*Primary Examiner* — William A Bolton
(74) *Attorney, Agent, or Firm* — Fox Rothschild LLP

(57) ABSTRACT

An electrode assembly for a vacuum interrupter includes a contact plate, an electrode coil, an inner support, a lower support, and at least one support member. The electrode coil includes a base for attachment to a terminal post of the vacuum interrupter. The electrode coil also includes at least one arcuate arm between the base and the contact plate extending along a curved path in a plane substantially perpendicular to a direction of travel of the electrode assembly. Each arcuate arm includes an aperture that is positioned to align with a corresponding aperture of an adjacent arcuate arm or the base of the electrode coil. Each support member is partially positioned within aligned apertures to maintain a gap between the arcuate arms and the base. The support members and the lower support may be slotted to decrease the current flowing through the supports.

22 Claims, 9 Drawing Sheets

(56) References Cited

U.S. PATENT DOCUMENTS

| | | | | |
|---|---|---|---|---|
| 5,438,174 | A * | 8/1995 | Slade | H01H 33/6644 218/118 |
| 5,793,008 | A | 8/1998 | Mayo et al. | |
| 5,804,788 | A | 9/1998 | Smith | |
| 6,506,992 | B2 * | 1/2003 | Kim | H01H 33/6644 218/123 |
| 6,649,855 | B2 * | 11/2003 | Nishijima | H01H 33/6642 218/123 |
| 6,765,168 | B2 * | 7/2004 | Takebuchi | H01H 33/6642 218/118 |
| 6,965,089 | B2 | 11/2005 | Stoving et al. | |
| 7,173,208 | B2 | 2/2007 | Harada et al. | |
| 7,250,584 | B2 * | 7/2007 | Asmus | H01H 33/6644 218/123 |
| 7,721,428 | B2 | 5/2010 | Stoving et al. | |
| 8,087,166 | B2 | 1/2012 | Stoving et al. | |
| 8,263,894 | B2 * | 9/2012 | Tak | H01H 33/6644 218/123 |
| 8,450,630 | B2 | 5/2013 | Stoving | |
| 9,040,862 | B2 | 5/2015 | Ryu | |
| 2008/0023445 | A1 * | 1/2008 | Haas | H01H 33/6642 218/141 |

OTHER PUBLICATIONS

Shaoyong, Cheng et al., "Experimental Investigation on the Arc Modes Transition of the AMF Electrode with One Turn Coil Structure", XXIInd Int. Symp. on Discharges and Electrical Insulation in Vacuum—Matsue—2006.

Yao, Xiaofei et al., "Development and Type Test of a Single-Break 126-kV/40-kA-2500-A Vacuum Circuit Breaker", IEEE Transactions on Power Delivery, vol. 31, No. 1, Feb. 2016.

Yu, Li et al., "Contacts Impact Phenomena in a 126 kV Vacuum Circuit Breaker", XXVth Int. Symp. on Discharges and Electrical Insulation in Vacuum—Tomsk—2012.

* cited by examiner

COIL-TYPE AXIAL MAGNETIC FIELD CONTACT ASSEMBLY FOR VACUUM INTERRUPTER

RELATED APPLICATIONS AND CLAIM OF PRIORITY

This patent document claims priority to U.S. Provisional Patent Application No. 62/885,571, filed Aug. 12, 2019. The disclosure of the priority application is fully incorporated into this document by reference.

BACKGROUND

This patent document relates to vacuum interrupters, and more particularly relates to improved axial magnetic field coils for vacuum interrupters.

Vacuum interrupters are typically used to interrupt electrical current flows. The interrupters include a generally cylindrical vacuum envelope surrounding a pair of coaxially aligned separable electrode assemblies having opposing contact surfaces. The contact surfaces abut one another in a closed circuit position and are separated to open the circuit. Each electrode assembly is connected to a current carrying terminal post extending outside the vacuum envelope and connecting to an electrical circuit.

An arc is typically formed between the contact surfaces when the contacts are moved apart to the open circuit position while carrying current. The arcing continues until the current is interrupted. Metal from the contacts that is vaporized by the arc forms a plasma during arcing and condenses back onto the contacts and also onto vapor shields placed between the electrode assemblies and the vacuum envelope after the current is extinguished.

The arc generally is initially in a constricted, columnar form that creates a thermal plasma. A thermal plasma has very high temperature and can support a significant current between the contacts, and therefore make the current more difficult to interrupt. It is advantageous to encourage the columnar arc to become a diffuse arc, leading to a lower temperature plasma and easier interruption at current zero. A diffuse arc, because it distributes the arc energy over a broader area of the contact surface, does not vaporize as much of the contact as does a columnar arc, and thereby extends the useful life of the contacts and the interrupter.

One technique of encouraging formation of a diffuse arc is by imposing an Axial Magnetic Field (AMF) in the region between the contacts. The field can be self-generated by the current in coils located behind each contact. A variety of electrode assemblies incorporating such coils for axial magnetic field vacuum interrupters are discussed in the article entitled "The Vacuum Interrupter Contact" by Paul Slade, *IEEE Trans. on Components, Hybrids, and Mfg. Tech.*, Vol. 7, No. 1, Mar. 1984.

Prior art coils, such as the coils disclosed in U.S. Pat. Nos. 4,260,864, 4,588,879 and 5,055,639, herein incorporated by reference, typically include current carrying arms radiating from a central hub, the radial arms connecting to arcuate coil elements. Some axial magnetic field vacuum interrupter designs, such as those disclosed in U.S. Pat. Nos. 4,675,483, 4,871,888, 4,982,059 and 5,313,030, herein incorporated by reference, have attempted to reduce or eliminate the radially extending portions of the coils by using cylindrical coils having a plurality of angled slots, the angled slots defining a plurality of helically extending current carrying arms. Other axial magnetic field vacuum interrupters, such as those disclosed in U.S. Pat. Nos. 3,823,287, 4,704,506 and 5,777,287, herein incorporated by reference, incorporate cylindrical coils which are spaced axially forward of a backing plate.

In all of the examples mentioned above, the azimuthal length of the arm is less than half a circle (i.e., 180°). To further increase the interruption capability of a vacuum interrupter to enable its applications into either a higher voltage and/or higher current rating, the length of the arcuate coil arm is increased to increase the self-generated AMF by the circular current flow along these arms. For example, a coil design may have an arm length about ⅔ of a circle (i.e., 240°), an arm length of ¾ of a circle (i.e., 270°), or a coil where the current is caused to flow a full circle (i.e., 360°) to generate a maximal AMF.

With the lengthening of the arm, however, the mechanical strength of the coil becomes weaker, with the long cantilever arm prone to deformation at its connection to the base (i.e., a starting point). This is further exasperated by the more and more stringent application conditions of the high voltage and high current rating. A higher voltage rating demands a larger travelling distance for the opening gap, and a faster opening speed. A higher current rating demands a larger coil diameter with a larger arm cross-section. These conditions pose a challenge on the mechanical integrity of the coil to withstand the closing and opening operations of the vacuum interrupter.

During a closing operation of the vacuum interrupter, the contacts of the electrode assemblies may be violently slammed together (i.e., under compression during a closing operation) to reconnect the circuit. During the normal operations, one or more small welds may form at the contacts interface between the movable contact and the fixed contact. During an opening operation of the vacuum interrupter, the circuit breaker must be able to break those small welds to separate the pair of contacts in order to interrupt the current of the circuit. In this weld-breaking process, the coil experiences a tensile load (i.e., under tension during an opening operation). The coil must be able to withstand this tensile load without plastic deformation, that is, without its arms being pulled apart.

During normal operations, the spaced coil arm can withstand the large tensile and compressive forces (e.g., stress forces) generated during these interruptions, but during critical events the forces are too large and change the shape of the coils (i.e., the arms of the coils become deformed). The coil arms may be pulled apart during the occurrence of large tensile forces or may be smashed together during the occurrence of large compressive forces. Deformed coils may impair and/or void the performance of the vacuum interrupter requiring costly replacements and lengthy service interruptions as the coils are permanently sealed inside the vacuum envelope. Electrode assemblies employed for higher voltage ratings also require longer coil arms, which are more prone to damage when compared to electrode assemblies for lower voltage ratings.

The most common way to solve the above-noted problems is to increase the cross-sectional area of the connection of the arm to its base, thereby reducing the arm length of each coil. This has the undesired effects of lowering the axial magnetic field produced by the coil.

It is therefore desirable to obtain an electrode assembly for a vacuum interrupter having a coil structure with supported arms which increases the useful life of the electrode assembly.

SUMMARY

In various embodiments, an electrode assembly for a vacuum interrupter includes a contact plate, an electrode coil, and at least one support member. The electrode coil includes a base for attachment to a terminal post of the vacuum interrupter, and at least one arcuate arm between the base and the contact plate extending along a curved path in a plane substantially perpendicular to a direction of travel of the electrode assembly. The electrode coil may be connected to the contact plate at or near the end of its arm or arms, or otherwise as described below.

In some embodiments, each arcuate arm includes an end surface that includes an aperture that is positioned to align with a corresponding aperture of an adjacent end surface of an adjacent arcuate arm. Each of the support members are partially positioned within aligned apertures to maintain a gap between adjacent end surfaces.

Alternatively or in addition, the apertures may be placed near the ends of the arcuate arm, and they may be positioned to hold a support pin that will maintain a gap between a lower surface of one arm and an upper surface of another arm, or between an arm and the contact plate or base of the electrode assembly.

In some embodiments, a filler material may be at least partially included with the aperture(s) to mechanically and electrically connect each support member and/or arcuate arm to the contact plate. Optionally, each support member may be a hollow pin and a portion of each aperture may be filled with the filler material. For example, the filler material may be a brazing material joining the support member and the arcuate arm to the electrode coil and the contact plate.

In some embodiments, the gap may have an angle of about 15 degrees to about 75 degrees with respect to the plane. For example, the gap has an angle of about 30 degrees with respect to the plane. Alternatively, the gap may have an angle of 90 degrees with respect to the plane.

In some embodiments, each arcuate arm may include an extension member connecting the arcuate arm to the base. The base may be generally disk-shaped, and each extension member may extend from its arcuate arm in a direction substantially perpendicular to the plane. All of the arcuate arms may collectively have an outer radius substantially equal to an outer radius of the generally disk-shaped base.

In some embodiments, each arcuate arm may include a raised portion connecting each arcuate arm to the contact plate. The contact plate may be generally disk-shaped, and the raised portion of each arcuate arm may extend in a direction substantially perpendicular to the plane. All of the arcuate arms may collectively have an outer radius substantially equal to an outer radius of the generally disk-shaped contact plate.

In some embodiments, the electrode coil may include three arcuate arms, and each of the arcuate arms may extend almost 120° around a circumference of the electrode assembly.

In some embodiments, the at least one arcuate arm may have a substantially uniform radius of curvature.

In some embodiments, the electrode assembly may further include an inner support and a lower support. The inner support may be attached between the contact plate and the base of the electrode coil, and may be positioned interior of the at least one arcuate arm. The lower support may be attached to the base of the electrode coil. In some embodiments, the base of the electrode coil may include at least one slot, the lower support may include at least one slot, and the at least one slot of the lower support may be positioned adjacent the at least one slot of the base.

In some embodiments, the support member may be a pin, may include longitudinal slot, may be hollow, and/or may be made of a material of a lower electrical conductivity than that of the material of the coil arm. For example, the support member may comprise materials such as steel, nickel chromium alloys (e.g., Nichrome) and titanium alloys, or even an insulating material, such as a ceramic.

In some embodiments each aperture may be located either on the raised portion of the arcuate arm, on the non-raised portion of the arcuate arm, or on both.

In another aspect of the disclosure, each arcuate arm may include at least one additional aperture positioned to align with a corresponding aperture of either an adjacent end surface of the adjacent arcuate arm or on the base.

DETAILED DESCRIPTION

As used in this document, the singular forms "a," "an," and "the" include plural references unless the context clearly dictates otherwise. Unless defined otherwise, all technical and scientific terms used herein have the same meanings as commonly understood by one of ordinary skill in the art. As used in this document, the term "comprising" means "including, but not limited to." When used in this document, the term "exemplary" is intended to mean "by way of example" and is not intended to indicate that a particular exemplary item is preferred or required.

In this document, when terms such "first" and "second" are used to modify a noun, such use is simply intended to distinguish one item from another, and is not intended to require a sequential order unless specifically stated. The term "about" and "approximately," when used in connection with a numeric value, is intended to include values that are close to, but not exactly, the number. For example, in some embodiments, the term "approximately" may include values that are within +/−10 percent of the value.

When used in this document, terms such as "top" and "bottom," "upper" and "lower," or "front" and "rear," are not intended to have absolute orientations but are instead intended to describe relative positions of various components with respect to each other. For example, a first component may be an "upper" component and a second component may be a "lower" component when a device of which the components are a part is oriented in a first direction. The relative orientations of the components may be reversed, or the components may be on the same plane, if the orientation of the structure that contains the components is changed.

The drawings are not to scale. The claims are intended to include all orientations of a device containing such components.

Figure 1:
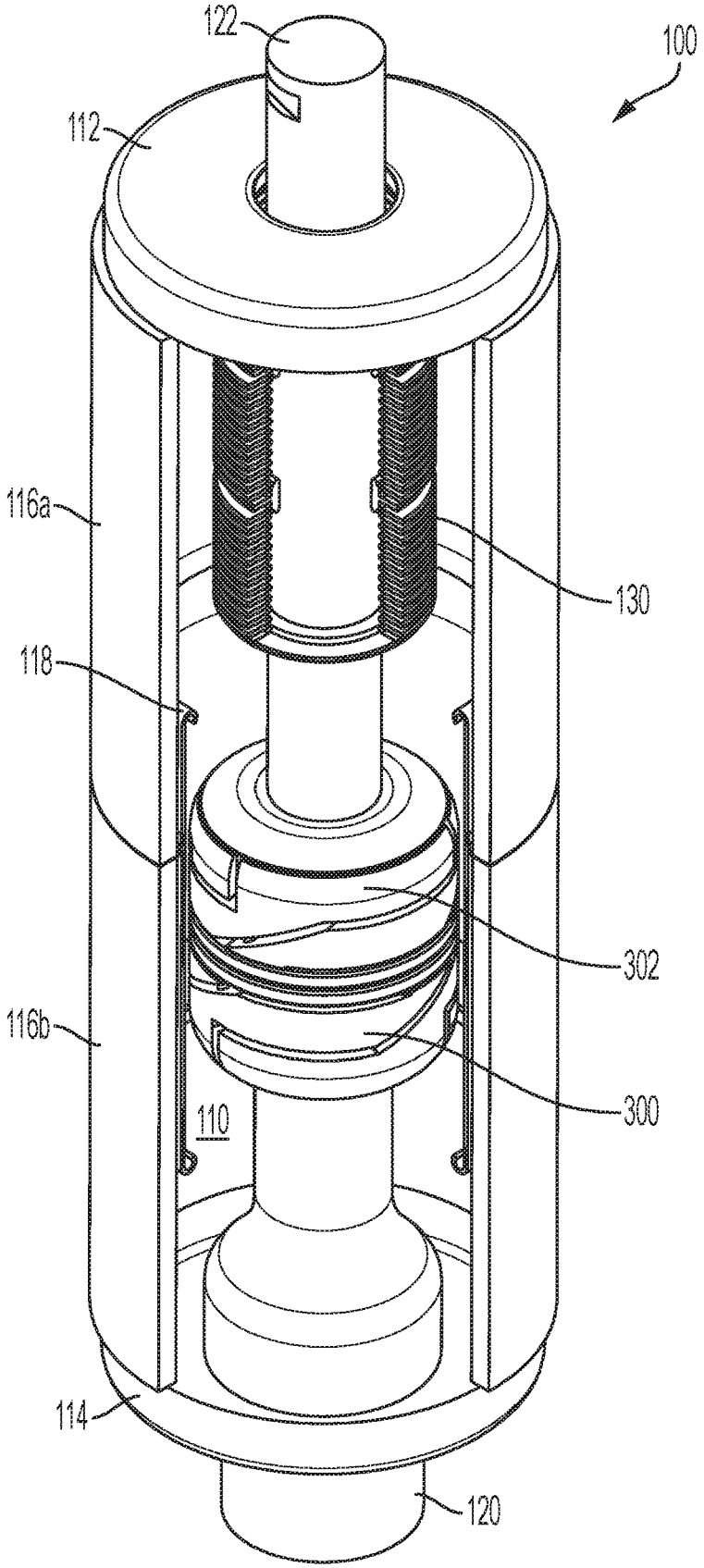
FIG. 1 is an isometric view of an example vacuum interrupter (with a section of a vacuum envelope removed) in which an electrode coil may be installed.
Figure 2:
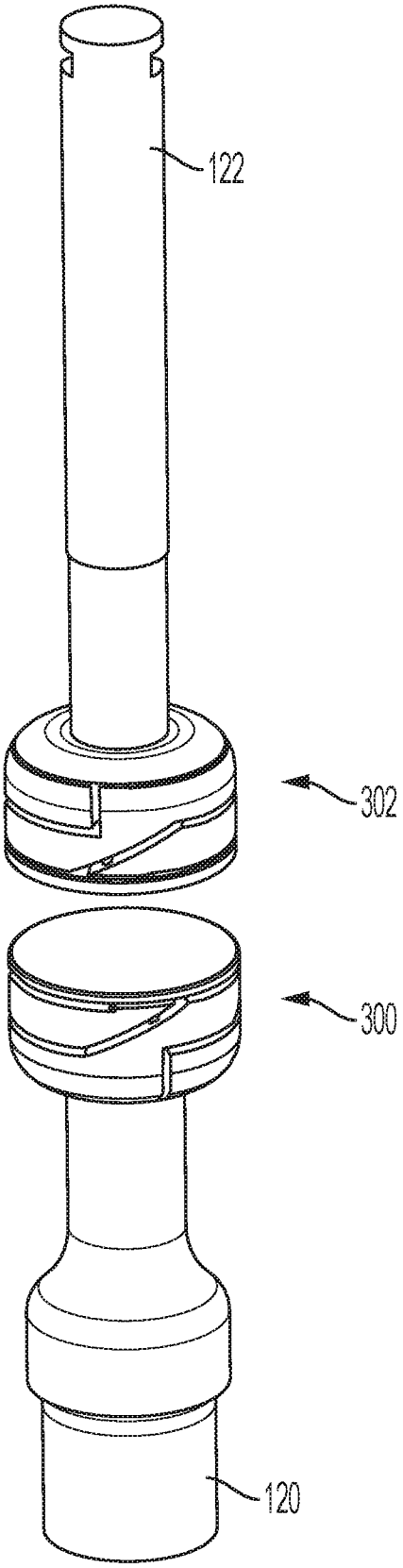
FIG. 2 is a partial view of the vacuum interrupter of FIG. 1 with the vacuum envelope removed.

Referring now to FIG. 1, a vacuum interrupter 100 according to an embodiment includes first and second electrode assemblies 300 and 302, first and second terminal posts 120 and 122, and a vacuum envelope 110. FIG. 2 is a partial view of the current carrying portion of the vacuum interrupter 100 of FIG. 1 with the vacuum envelope 110 removed.

The vacuum envelope 110 includes spaced end caps 112 and 114 joined by one or more tubular insulating casings 116*a*, 116*b*. A vapor shield 118 may be included in the vacuum envelope 110 and may be either electrically isolated from the electrode assemblies 300 and 302 or connected to only one of the electrode assemblies 300 and 302. It protects the insulating surface of the insulating casings 116*a*, 116*b* from being degraded by the metal vapors generated during a circuit interruption event. The vacuum envelope 110 surrounds both electrode assemblies 300 and 302 to form the capsule of the vacuum.

First and second terminal posts 120 and 122 are electrically coupled to the first and second electrode assemblies 300 and 302, respectively, for coupling the first and second electrode assemblies 300 and 302 to an electrical circuit. A mechanism, such as a bellows assembly 130, permits axial movement of at least one of the electrode assemblies 300 and 302 between a closed circuit position (FIG. 1) and an open circuit position (FIG. 2) while maintaining the vacuum seal of the vacuum envelope 110. The first and second electrode assemblies 300 and 302 and the first and second terminal posts 120 and 122 define a common longitudinal axis for the vacuum interrupter 100.

Figure 3:
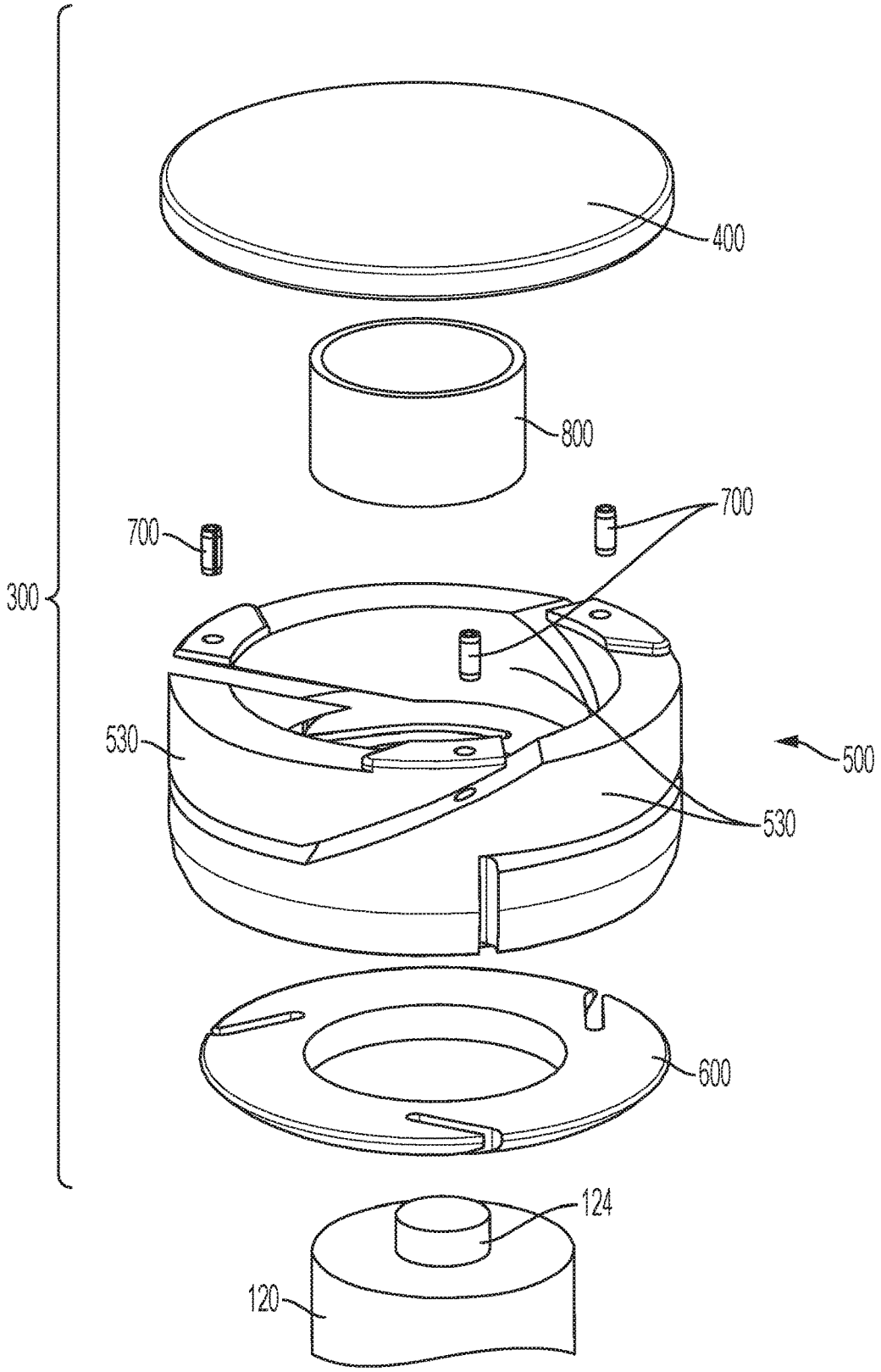
FIG. 3 is an exploded view of example components of an electrode assembly.
Figure 4A:
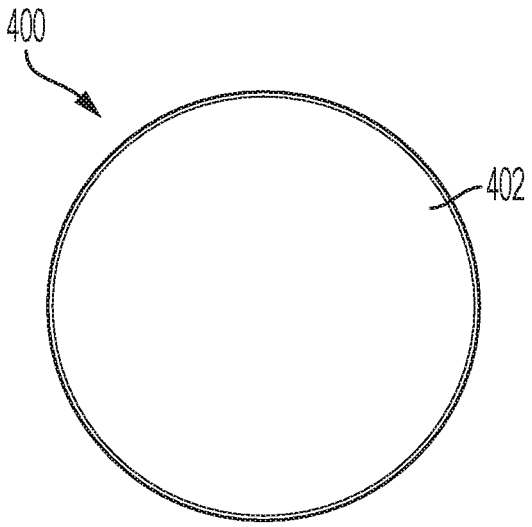
FIGS. 4A-4D are top, side, bottom, and isometric views of a contact plate.
Figure 4B:
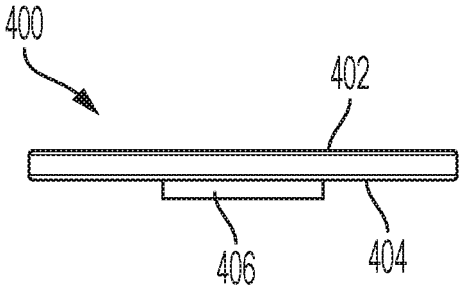
Figure 4C:
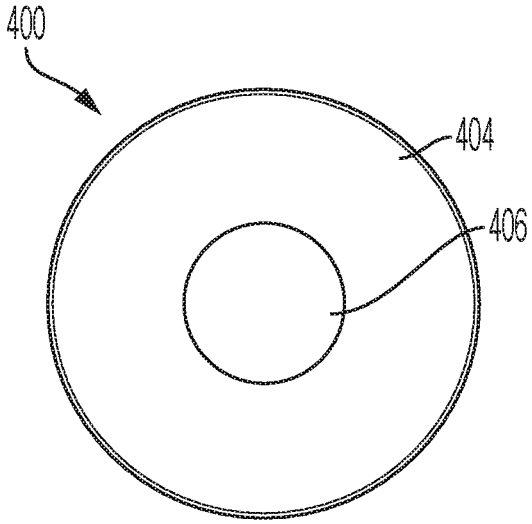
Figure 4D:
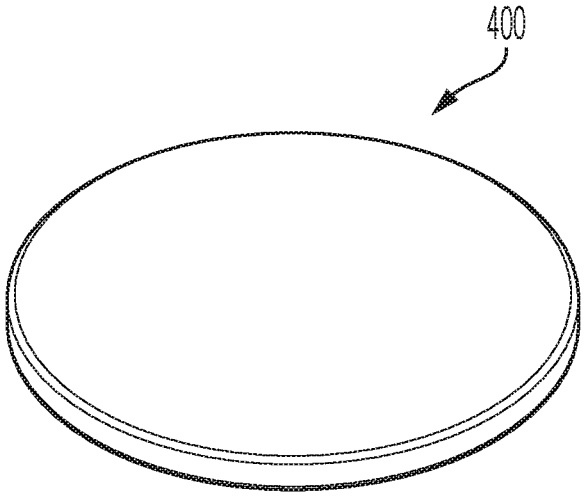

FIG. 3 is an exploded view of the components of an electrode assembly 300 and a partial view of a terminal post 120 upon which it is connected. The electrode assembly 300 includes a contact plate 400, an inner support 800, a generally cup-shaped electrode coil 500 having three arcuate arms 530 (as will be described in more detail below), a lower support 600, and three support members 700 positioned between (and optionally partially in) the arcuate arms 530 (as will be described in more detail below). To assemble the components of an electrode assembly 300, the support members 700 are positioned between the arcuate arms 530 of the electrode coil 500, the inner support 800 is positioned within the interior of the electrode coil 500, the contact plate 400 is positioned atop the arcuate arms 530 of the electrode coil 500 and the inner support 800, and the electrode coil 500 is positioned atop the lower support 600 and the terminal post 120. Note that each electrode assembly 300, 302 of FIGS. 1 and 2 may have a structure such as shown in FIGS. 3 to 11. Thus, as previously mentioned, the reference to items as being "top" and "bottom," "above" and "below," "atop" and "under," "upper" and "lower," or "front" and "rear," is only intended to be relative and to reflect the orientation shown in FIG. 3. A similar electrode assembly 302 would necessarily be inverted as compared to the assembly for electrode assembly 300. Or, the electrode assemblies may be aligned either tilted or sideways on a horizontal plane.

The contact plate 400, electrode coil 500, and terminal posts 120 and 122 are all made from materials having high electrical conductivity for electric current flow, whereas the lower support 600, support members 700, and inner support 800 are all made from materials having high electrical resistivity to electric current flow. This allows the current to pass along the electrode assemblies 300 and 302 with little to no effect of the support devices 600, 700, 800 from interfering with the desired circular flow generatoring the axial magnetic field within the vacuum envelope 110. For example, the contact plate 400 may be made from copper-chromium (Cu—Cr) alloys, the electrode coil 500, and terminal post 120 may be made from Oxygen-free copper (OFC), CuCr alloys, or other suitable materials whereas the lower support 600, support members 700, and inner support 800 may be made from stainless steel, ceramic, or other suitable materials. For example, nickel chromium alloys (e.g., Nichrome) and titanium alloys are suitable support materials with high electrical resistivity (as compared to the resistivity of the electrode arms), low vapor pressures, and high melting points compatible with vacuum brazing.

FIGS. 4A-4D are top, side, bottom, and isometric views respectively of a contact plate 400 in accordance with various embodiments. The contact plate 400 includes an outer surface 402 and an inner surface 404. The contact plate 400 may be attached to the inner support 800 by any suitable structure, such as a raised portion 406 on the inner surface 404 which fits inside or around the inner support 800. When the contact plate 400 of one electrode assembly 300 is in contact the contact plate 400 of the other electrode assembly 302 (i.e., the contact plates make contact), the circuit is closed and current is allowed to continuously pass. When the contact plates 400, 400 are separated, the circuit is opened and current is interrupted. To close the circuit again, the contact plates 400, 400 are returned to the contact position. As mentioned above, this pulling apart and pushing together of the contact plates 400, 400 creates large stress forces (tensile and compressive). The support members 700, however reinforce the rigidity of the electrode assembly 300 to enable it to withstand these large stress forces, as will be described in more detail below.

FIGS. 5A-5D are top, side, bottom, and isometric views respectively of an electrode coil 500 in accordance with various embodiments. The electrode coil 500 may have a base 510 and at least two arcuate arms 530. For example, as illustrated in FIGS. 5A-5D, the electrode coil 500 may have three arcuate arms 530A, 530B, and 530C (hereinafter 530 unless distinctly one or the other), each of which has a substantially uniform radius of curvature and extends almost 120° around the circumference of the coil to provide a circumferential current path. While three arcuate arms are shown, it is to be understood that any suitable number of arcuate arms may be used. For example, a single arcuate arm extending almost 360° around the circumference of the coil may be used. Alternatively, two, four, or more arcuate arms may be used, provided that the arms together extend around the circumference in one or more rings (for example, in a stacked or spiral structure), and are capable of generating a sufficient axial magnetic field during operation of the electrode coil. The arcuate arm 530 may extend along a curved path in a plane substantially perpendicular to a direction of travel of the electrode assembly. Furthermore, while the arcuate arms shown in FIGS. 5A-5D have a substantially uniform radius of curvature with respect to the center of the coil, other configurations such as spiral arms may be used. In some embodiments, although not required, the base 510 and arcuate arms 530 may be fabricated from a single piece of material. The material of these components may be any material having sufficient electrical conductivity and heat transfer capability. Metals such as copper and Cu/Cr composites are suitable.

Figure 5A:
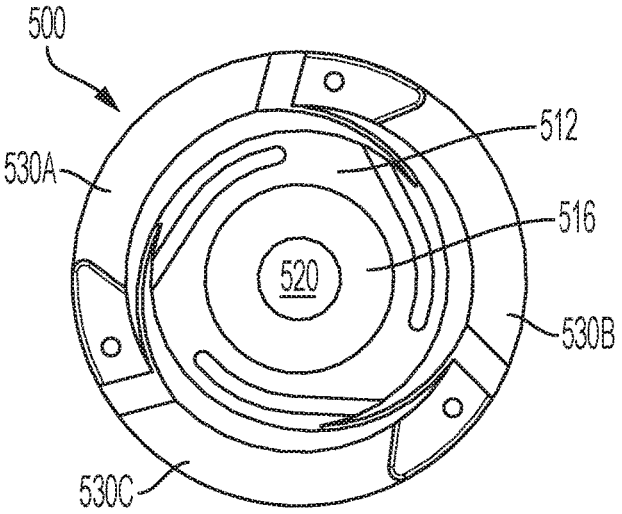
FIGS. 5A-5D are top, side, bottom, and isometric views of an electrode coil.
Figure 5B:
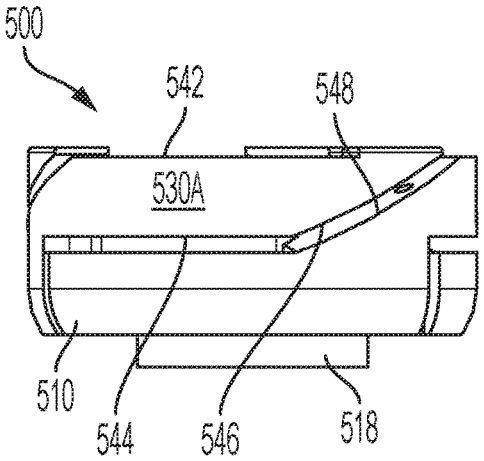
Figure 5C:
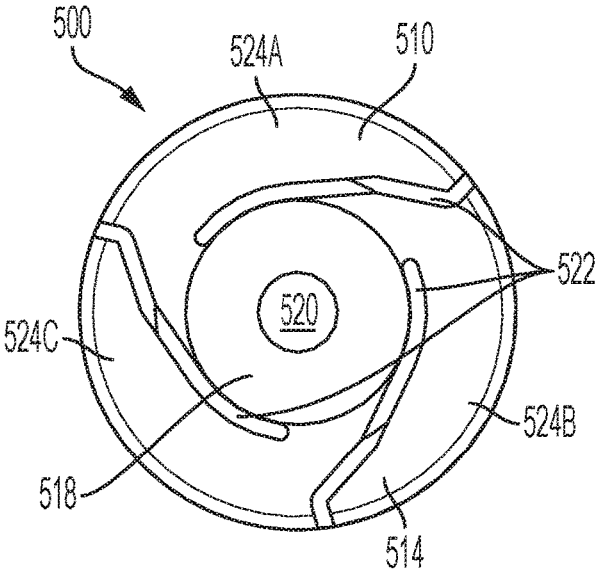

Referring to FIGS. 5A and 5C, the base 510 is generally disk shaped having an inner surface 512 and an outer surface 514. The inner surface 512 may include a circular indentation 516 for receiving the inner support 800, as will be described in more detail below. The outer surface 514 may include a circular raised portion 518 for receiving the lower support (600 of FIG. 3), as will be described in more detail below. The base 510 may include an aperture 520 for receiving a protrusion (124 of FIG. 3) on an end of a terminal post 120 by any connection methods, such as welding, brazing, soldering, press fitting (e.g., interference fitting), or other connection methods. The aperture 520 may pass through the center of the base 510 which prevents gas entrapment. The base 510 may include slots 522 forming radial extensions 524. For example, as illustrated in FIG. 5C, the base 510 may have three radial extensions 524A, 524B, and 524C.

Figure 5D:
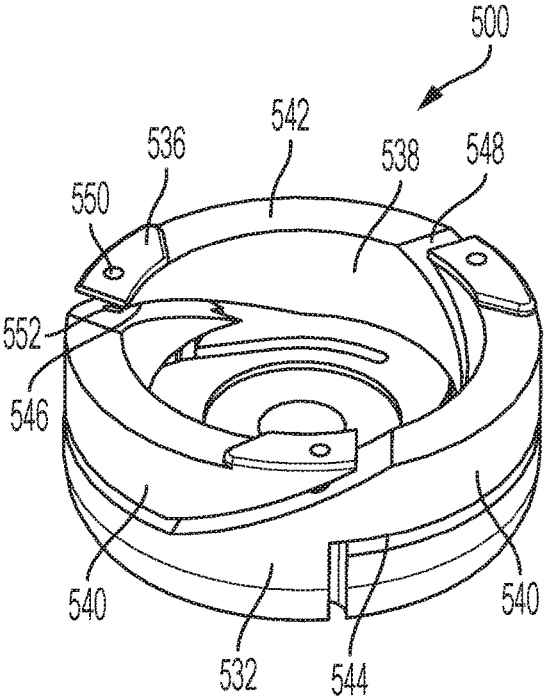
Figure 6A:
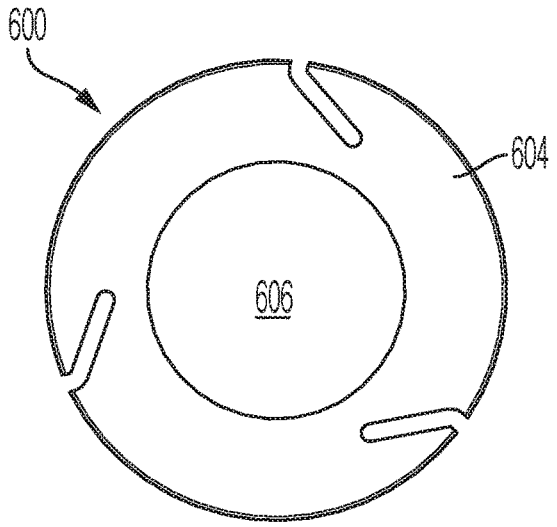
FIGS. 6A-6D are top, side, bottom, and isometric views of a lower support.
Figure 6B:
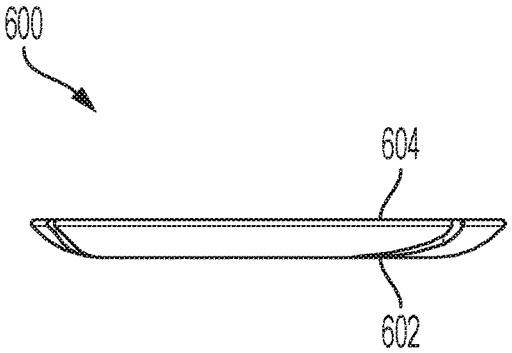
Figure 6C:
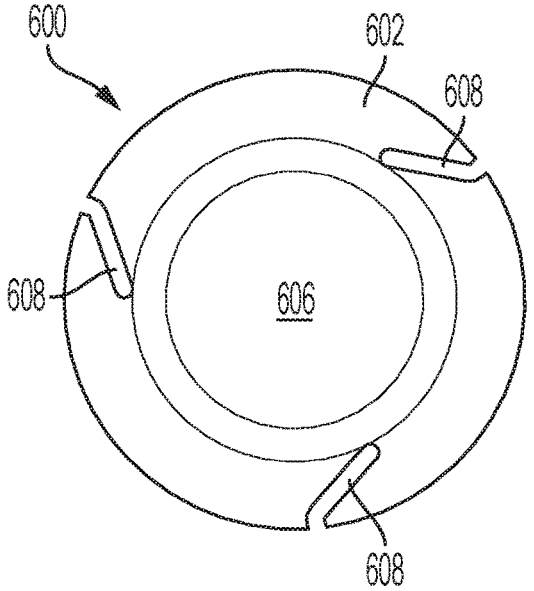
Figure 6D:
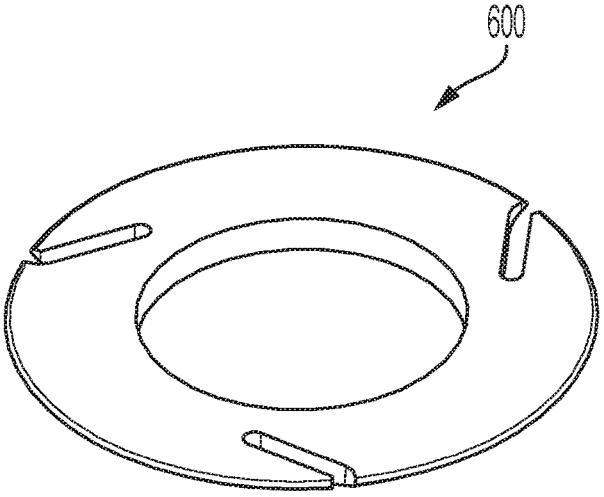

Referring to FIGS. 5B and 5D, each arcuate arm 530 may include an extension member 532 that extends from the arcuate arm 530 and that connects the arcuate arm 530 to the base 510, and a raised portion 536 for connecting to inner surface 404 of the contact plate 400. Each arcuate arm 530 includes an inner surface 538, an outer surface 540, an upper surface 542, a lower surface 544, a first end surface 546, and second end surface 548. The first end surface 546 of one arcuate arm 530 may face the second end surface 548 of an adjacent arcuate arm 530 forming a gap G. Collectively the arcuate arms 530 nearly form a complete circle around the circumference of the electrode coil 500 with only minor gaps G between the first and second end surfaces 546, 548 of each arcuate arm 530. The gaps G between each of the end surfaces 546, 548 may extend along the longitudinal direction of the vacuum interrupter 100 (i.e. having a right angle) or may be radially slanted in a range of about 10° to almost 90°, a range of about 15° to about 60°, a range of about 20° to about 45°, or a range of about 25° to about 35°. For example, as shown in FIG. 5B, the gaps G between each of the end surfaces 546, 548 is slanted approximately 30°. For comparison, in the embodiment shown in FIG. 10, the gaps G between each of the end surfaces 546', 548' are not slanted.

For an electrode coil having arcuate arms in a single plane with no base (not shown), the upper surface 542 faces the contact plate 400 and the lower surface 544 faces the lower support 600. For an electrode coil 500 having a single level of arcuate arms 530 extending from the inner surface 512 of the base 510, for example as illustrated in FIGS. 5A-5D and 10, the upper surface 542 faces the contact plate 400 and the lower surface 544 faces the inner surface 512 of the base 510. Each arcuate arm 530 may include an extension member 532 that extends from the lower surface 544 of the arcuate arm 530 and that connected the arcuate arm 530 to the base 510.

For an electrode coil having multiple levels of arcuate arms radially extending from the inner surface of the base (i.e., in a helical shape such that each arcuate arm extends a radial arc greater than 360°/n where n is the total number arcuate arms; not shown), the upper surface 542 of one level faces the contact plate, while the lower surface 544 of a different level faces the base 510. These two levels may be adjacent to each other, or additional levels may be between them.

In all embodiments, at least a portion of end surfaces of all arcuate arms partially faces an end surface of another arcuate arm. The gap G (e.g., distance) between these two end surfaces are maintained by the support member 700, as will be described in more details below.

Figure 9:
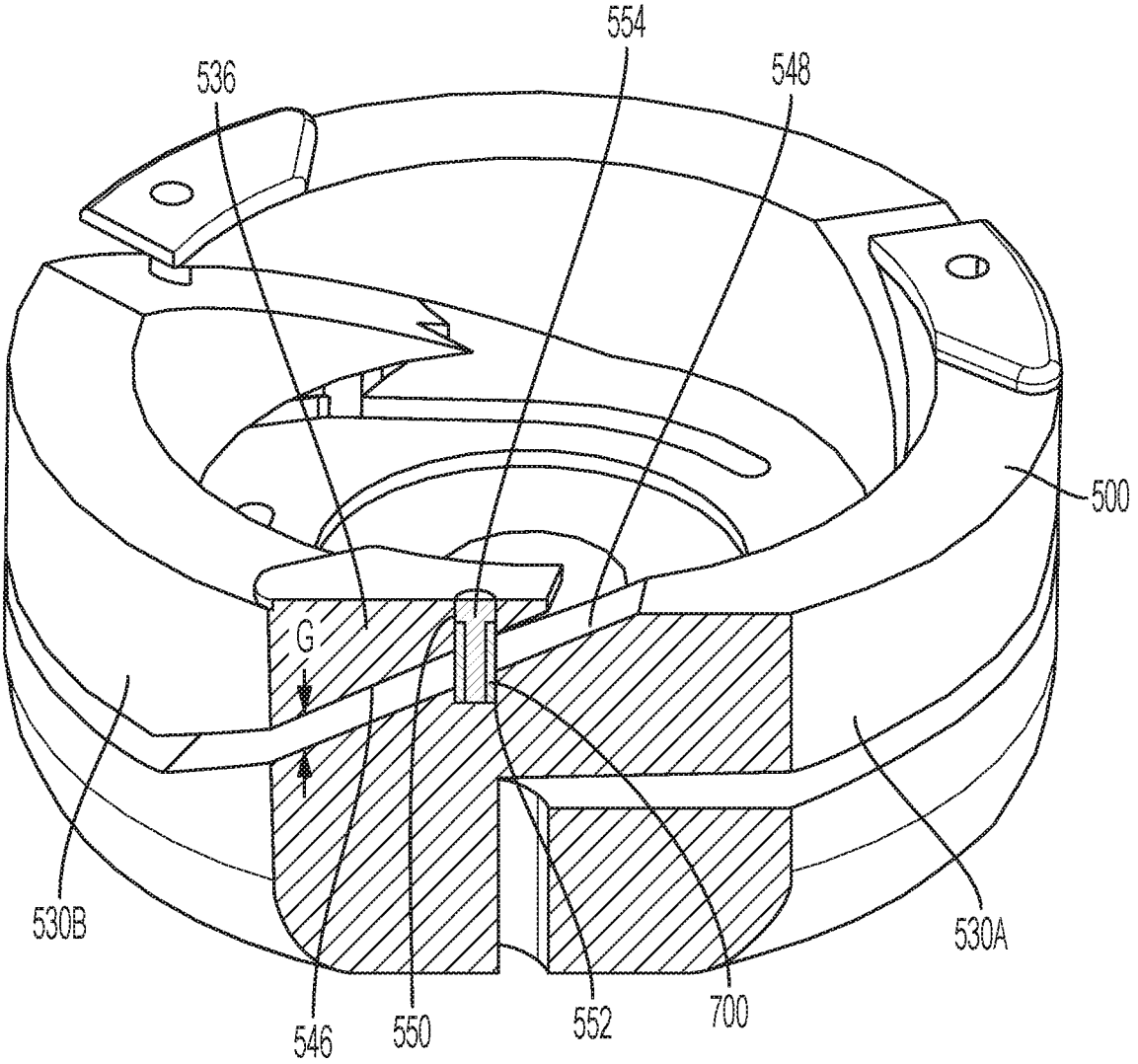
FIG. 9 is a sectional view along one support member positioned within an electrode coil.

Each arcuate arm 530 includes at least one aperture 550, 552 extending into one or both of its end surfaces 546 or 548. Optionally, the aperture may extend through the arcuate arm 530 to the corresponding upper surface 542 or lower surface 544 (e.g., as a through bore), or it may extend only partially into the arcuate arm 530 as a recess. Each aperture 552 may be aligned with a corresponding aperture 550 of an adjacent arcuate arm 530 (or with an aperture on the arcuate arm's other end if only one arcuate arm is used). The apertures 550, 552 may be formed by any suitable method such as, for example, by drilling. As shown in FIGS. 3 and 9, the apertures 550, 552 may be formed parallel to the longitudinal axis of the vacuum interrupter 100 or, alternatively, the apertures 550, 552 may be formed at a non-parallel angle. For example, the apertures 550, 552 may be formed normal to the end surfaces 546, 548. The apertures 550, 552 may be formed before or after the arcuate arms 530 of electrode coil 500 are formed to their final shape. FIGS. 3 and 9 illustrate that portions of each support member 700 are fixed within the aperture pair 550, 552 of each pair of adjacent arcuate arms 530, as will be described in more detail below. The pin 700 helps to maintain the gap G between the end surfaces of adjacent arcuate arms.

FIGS. 6A-6D are top, side, bottom, and isometric views respectively of a lower support 600 in accordance with various embodiments. The lower support 600 may be positioned adjacent the outer surface 514 of the electrode coil 500 to support the electrode coil 500 during vacuum interrupter operations. The lower support 600 includes an outer surface 602, an inner surface 604, and an aperture 606. The aperture 606 is sized to permit the circular raised portion 518 on the outer surface 514 of the electrode coil 500 to pass through with suitable connection methods, such as welding, brazing, soldering, press fitting (e.g., interference fitting), or other connection methods. The lower support 600 may optionally include at least one outwardly extending slot 608 similar in placement as the slots 522 on the base 510 of the electrode coil 500. The lower support 600 having slots 608 may increase the axial magnetic field by decreasing the current flowing through the supporting plate 600. The lower support 600 having slots 608 may be on either the first electrode assembly 300 (see FIG. 3), the second electrode assembly 302, or both. Likewise the lower support 600 may optionally not include slots (see the second electrode assembly 302 in FIG. 2).

Figure 7:
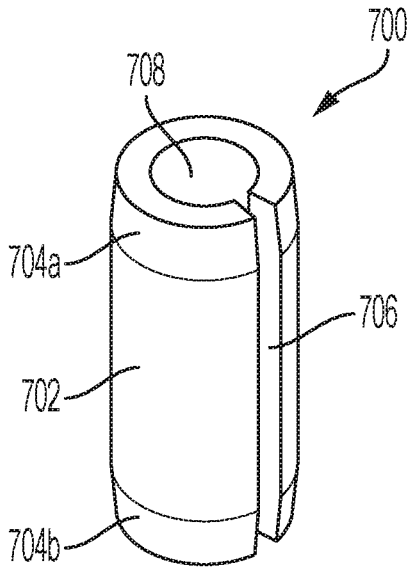
FIG. 7 is an isometric view of a support member.

The support member 700 mechanically connects the free end of one arcuate arm 530 of the electrode coil 500 rigidly to another portion of the electrode coil 500 to serve as a spacer and to provide resistance to tensile forces and compressive forces during cyclic operations of the vacuum interrupter 100. For example, the support member 700 may be a pin, a threaded screw, an elongated beam, or the like. The support member 700 may be positioned vertically into matching apertures 550, 552 on the first end surface 546 and second end surface 548 so as to mechanically connect the first end surface 546 of one arcuate arm 530 rigidly to the second end surface 548 of another arcuate arm 530. For example, a pin shaped support member 700 as illustrated in FIG. 7 may be positioned into matching apertures 550, 552. Alternatively, the support member 700 may be a threaded screw support member positioned vertically into matching threaded apertures 550, 552. Optionally, the support member 700 may be positioned radially between matching channels on the first end surface 546 and second end surface 548 so as to mechanically connect (e.g., interlock) the first end surface 546 of one arcuate arm 530 rigidly to the second end surface 548. For example, an I-beam shaped support member 700 may be positioned radially into matching T-shaped channels on the first end surface 546 and second end surface 548.

Each support member 700 may be made from a material which provides both resistance to tensile forces and compressive forces. For example, the support members 700 made of stainless steel minimizes the long cantilevered portions of the arcuate arms from being pulled apart from the other components of the electrode coil under a tensile load and from being plastically deformed under a compression load. The support members 700 may also be made from material that is substantially more electrically resistive (less conductive) than the electrode arms, in order to allow the current to flow undisturbed by the support members 700. As noted above, example materials include stainless steel, nickel chromium alloys (e.g., Nichrome), and titanium alloys.

FIG. 7 is an isometric view of a pin-shaped support member 700 in accordance with various embodiments. Each support member 700 may include an outer wall 702 that is optionally cylindrical, and optionally includes tapered ends 704*a*, 704*b* to assist with insertion through the apertures (550, 552 in FIGS. 5D and 9) of each arcuate arm 530 of the electrode coil 500. The support member 700 may have an outer sidewall with a diameter (or other measurement of width, if non-circular) that is less than the inner diameter of the apertures 550, 552 of the arcuate arms 530 to allow the support member 700 to be placed within the apertures 550, 552. The support member 700 may optionally have a hollow core 708 centrally located, for example, to increase resistivity of the support member's entire volume. The support member 700 may also have a longitudinal slot 706 that extends from one end 704*a* of the sidewall to the other end 704*b* of the sidewall and that is aligned with the axial direction of the vacuum interrupter 100 to minimize eddy current induced in the support member 700 itself.

Figure 8:
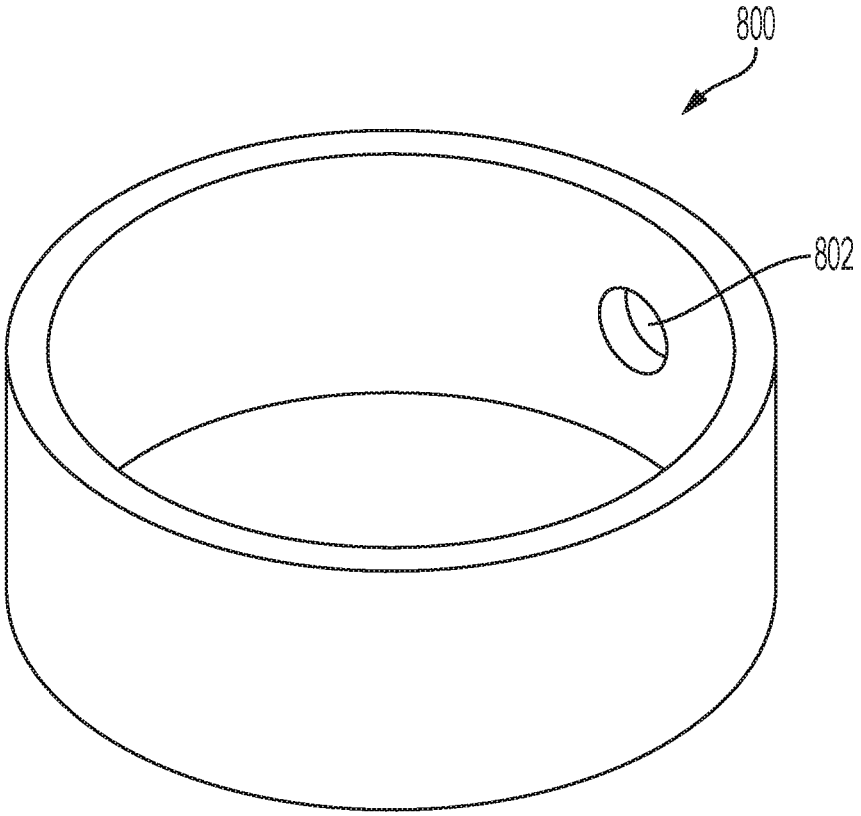
FIG. 8 is an isometric view of an inner support.

FIG. 8 is an isometric view of an inner support 800 that may be included in some embodiments. The inner support 800 fits within the circular indentation 516 in the base 510 of the electrode coil 500 (see FIG. 5A). A hole 802 may be provided through the inner support 800 in order to prevent gas from being trapped in the inner support 800. As shown in FIG. 3, the contact plate 400 is attached to the inner support 800 by the circular raised portion 406 which fits inside the inner support 800.

FIG. 9 is a sectional view along one support member 700 positioned within an electrode coil 500 in accordance with various embodiments. The support member 700, for example, may be positioned with an aperture 550 of a first arcuate arm 530B and then abutting into a matching aperture 552 in a second arcuate arm 530A. The remaining void may be filled with a filler material. For example, a brazing element 554 having a pre-form of a T-shape matching the initial void to properly and solidly join the support member 700 to first arcuate arm 530A, second arcuate arm 530B, and contact plate 400. The T-shaped brazing element 554 may be placed within the hollow portion 708 of the support member 700 within the apertures 550, 552 such that an upper surface of the brazing element 554 extends above the raised portion 536 of the arcuate arm 530. The contact plate 400 may be placed against the upper surfaces of the brazing elements 554 and the raised portions 536 of the arcuate arms 530 and then heated to the brazing temperature. During this brazing process, the brazing elements 554 is heated to a molten form and allowed to conform to the adjacent surfaces during cooling, thus connecting the contact plate 400 to the arcuate arms 530 and the support members 700. This connection improves the ability of the electrode coil 500 from withstanding tensile forces during opening operations while strengthening the arcuate arms 530 of the electrode coil 500 to withstand compressive forces during closing operations.

Figure 10:
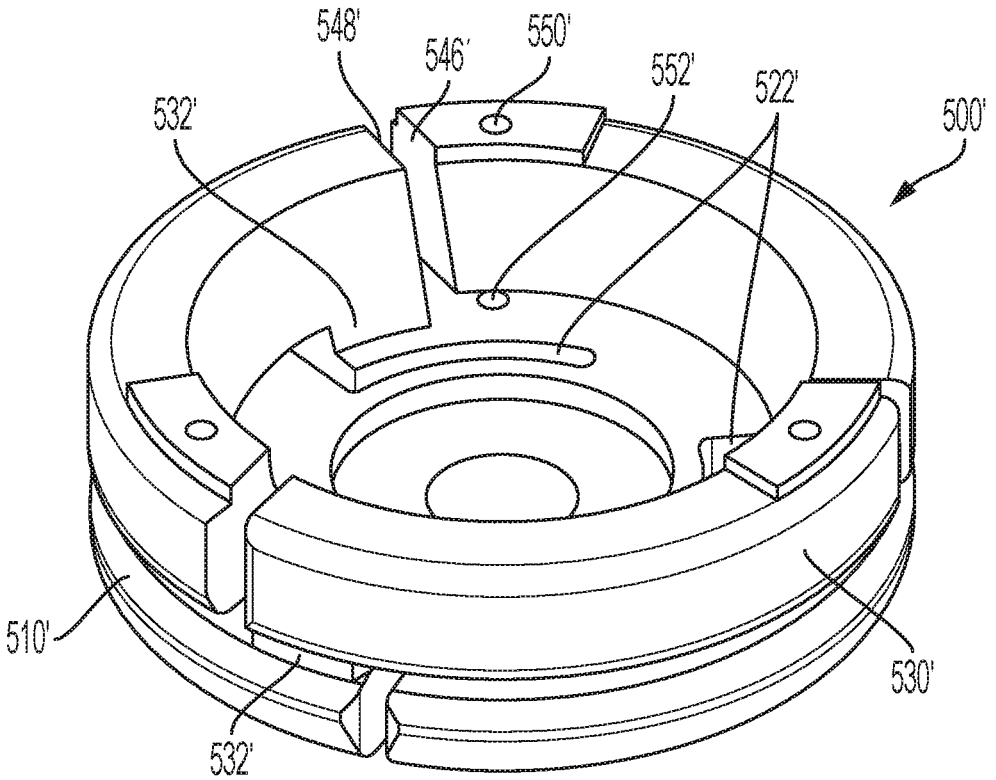
FIG. 10 is an isometric view of an alternate electrode coil.

FIG. 10 is an isometric view of an alternate electrode coil 500' in accordance with another embodiment. Each arcuate arm 530' of the electrode coil 500' may have an extension member 532' extending from the arcuate arm 530' in a longitudinal direction (i.e., parallel with the longitudinal direction of the vacuum interrupter 100) and connecting the arcuate arm 530' to the base 510'. In this embodiment, the gap G between the end surfaces 546', 548' of adjacent arcuate arms 530' has a vertical axis (i.e., it is parallel to the path of travel of the interrupter when activated), Thus, the aperture 550' on one of the arcuate arms 530' may align with a corresponding aperture 552' located on the base 510'.

Figure 11:
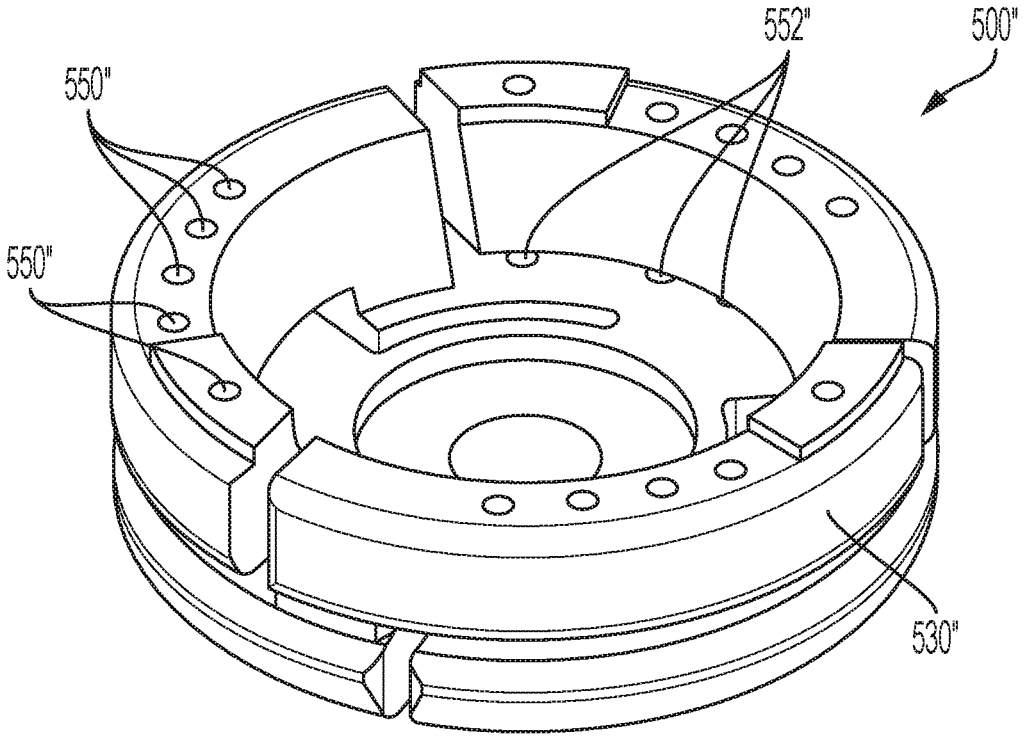
FIG. 11 is an isometric view of another electrode coil similar to that of FIG. 10.

FIG. 11 is an isometric view of another electrode coil 500" similar to FIG. 10 in accordance with another embodiment. The electrode coil 500" may have more than one aperture 550" in each arcuate arm 530", positioned to align with matching apertures 552" located on the base 510. For example, the electrode coil 500" shown in FIG. 11 includes five apertures 550" on each arcuate arm 530".

The above-disclosed features and functions, as well as alternatives, may be combined into many other different systems or applications. Various presently unforeseen or unanticipated alternatives, modifications, variations or improvements may be made by those skilled in the art, each of which is also intended to be encompassed by the disclosed embodiments.

The invention claimed is:

1. An electrode assembly for a vacuum interrupter, the electrode assembly comprising:
- a contact plate;
- an electrode coil connected to the contact plate, the electrode coil including:
  - a base for attachment to a terminal post of the vacuum interrupter, and
  - at least one arcuate arm between the base and the contact plate, each arcuate arm extending along a curved path in a plane approximately perpendicular to a direction of travel of the electrode assembly; and
- at least one support member;
- wherein:
  - each arcuate arm of the electrode coil includes an end surface that includes an aperture that is positioned to align with a corresponding aperture of an adjacent end surface of an arcuate arm of the electrode coil, and
  - each support member is partially positioned within aligned apertures to maintain a gap between adjacent end surfaces.

2. The electrode assembly of claim 1, wherein the at least one support member comprises a material having a higher electrical resistivity than that of the at least one arcuate arm.

3. The electrode assembly of claim 1, wherein the at least one support member is a pin support.

4. The electrode assembly of claim 1, wherein the at least one support member comprises a hollow core.

5. The electrode assembly of claim 4, wherein the at least one support member further comprises a longitudinal slot that extends from a first end of a sidewall of the support member to an opposite second end of the sidewall of the support member.

6. The electrode assembly of claim 1, further comprising a filler material that fills a portion of at least one of the apertures and secures the arcuate arm of which the at least one aperture is a part to the contact plate.

7. The electrode assembly of claim 6, wherein:
the filler material is a brazing element;
each support member includes a hollow portion; and
the brazing element is positioned within the hollow portion of each support member to connect the contact plate to the support member and the arcuate arm of which the aperture is a part.

8. The electrode assembly of claim 1, wherein the gap has an angle of about 30 degrees with respect to the plane.

9. The electrode assembly of claim 1, wherein the gap has an angle of about 15 degrees to about 75 degrees with respect to the plane.

10. The electrode assembly of claim 1, wherein:
each arcuate arm comprises a raised portion connecting that arcuate arm to the contact plate; and
the raised portion of each arcuate arm extends in a direction approximately perpendicular to the plane.

11. The electrode assembly of claim 1, wherein all of the arcuate arms collectively have an outer radius that is approximately equal to an outer radius of the contact plate.

12. The electrode assembly of claim 1, wherein:
the electrode coil includes three of the arcuate arms; and
each of the arcuate arms extends almost 120° around a circumference of the electrode assembly.

13. The electrode assembly of claim 1, further comprising a lower support that is attached to the base of the electrode coil,
wherein:
the base of the electrode coil further includes a slot,
the lower support includes a slot, and
the slot of the lower support is positioned adjacent the slot of the base.

14. The electrode assembly of claim 1, further comprising an inner support that is attached between the contact plate and the base of the electrode coil, and that is positioned interior of each of the arcuate arms.

15. A vacuum interrupter comprising the electrode assembly of claim 1.

16. The electrode assembly of claim 1, wherein:
the end surface of each arcuate arm is at least partially radially slanted; and
the gap between adjacent end surfaces is also at least partially radially slanted.

17. An electrode assembly for a vacuum interrupter, the electrode assembly comprising:
a contact plate;
an electrode coil connected to the contact plate, the electrode coil including:
a base for attachment to a terminal post of the vacuum interrupter, and
at least one arcuate arm between the base and the contact plate, each arcuate arm extending along a curved path in a plane approximately perpendicular to a direction of travel of the electrode assembly;
at least one support member; and
at least one brazing element;
wherein:
each arcuate arm includes an aperture that is positioned to align with a corresponding aperture in the base,
each support member is partially positioned within aligned apertures to maintain a gap between the arcuate arm and the base,
each brazing element joins the contact plate to a support member and a corresponding arcuate arm,
at least one of the support members comprises a hollow core, and
the brazing element for each such support member extends into the hollow core of that support member.

18. The electrode assembly of claim 17, wherein the at least one support member comprises a material having a higher electrical resistivity than that of the at least one arcuate arm.

19. The electrode assembly of claim 17, wherein the at least one support member is a pin support.

20. The electrode assembly of claim 17, wherein the at least one support member further comprises a longitudinal slot that extends from a first end of a sidewall of the support member to an opposite second end of the sidewall of the support member.

21. The electrode assembly of claim 17, wherein each arcuate arm comprises an extension member connecting the arcuate arm to the base.

22. The electrode assembly of claim 17, wherein:
the contact plate is generally disk-shaped; and
a raised portion of each arcuate arm extends in a direction approximately perpendicular to the plane.

* * * * *